US008998665B1

(12) United States Patent
Hoskins

(10) Patent No.: US 8,998,665 B1
(45) Date of Patent: Apr. 7, 2015

(54) BODY BOARD SYSTEM

(71) Applicant: Michael Hoskins, Newport Beach, CA (US)

(72) Inventor: Michael Hoskins, Newport Beach, CA (US)

( * ) Notice: Subject to any disclaimer, the term of this patent is extended or adjusted under 35 U.S.C. 154(b) by 153 days.

(21) Appl. No.: 13/760,522

(22) Filed: Feb. 6, 2013

Related U.S. Application Data

(60) Provisional application No. 61/595,199, filed on Feb. 6, 2012.

(51) Int. Cl.
*B63B 35/81* (2006.01)
*B63B 35/79* (2006.01)

(52) U.S. Cl.
CPC ..... *B63B 35/7906* (2013.01)

(58) Field of Classification Search
CPC ..... E05Y 2201/68; Y10S 16/24
USPC ..... 441/65–79; 16/110.1–114.1, 405–430, 16/337, 341
See application file for complete search history.

(56) References Cited

U.S. PATENT DOCUMENTS

| | | | | |
|---|---|---|---|---|
| 1,026,781 | A * | 5/1912 | Hahnsen | 16/337 |
| 2,936,466 | A | 5/1960 | Szymczyk et. al. | |
| 3,066,327 | A | 12/1962 | Durfey | |
| 3,422,778 | A | 1/1969 | Halfon | |
| 4,020,782 | A | 5/1977 | Gleason | |
| 4,028,761 | A | 6/1977 | Taylor | |
| 4,302,860 | A | 12/1981 | Puch | |
| 4,619,619 | A | 10/1986 | Muse, Jr. | |
| 4,678,445 | A | 7/1987 | Monreal | |
| 4,708,675 | A | 11/1987 | Shoeffler et al. | |
| 4,733,905 | A | 3/1988 | Buickerood et al. | |
| 4,805,546 | A | 2/1989 | Geller et al. | |
| 4,872,861 | A | 10/1989 | Gaudin | |
| 4,894,033 | A | 1/1990 | Chang | |
| 4,923,427 | A | 5/1990 | Roland | |
| 5,247,898 | A | 9/1993 | Thornlimb | |
| 5,318,467 | A | 6/1994 | McIntyre | |
| 5,462,001 | A * | 10/1995 | Lemelson | 114/253 |
| 5,489,228 | A | 2/1996 | Richardson et al. | |
| 5,514,017 | A | 5/1996 | Chimiak | |
| 5,569,057 | A | 10/1996 | Barsdorf et al. | |
| 5,797,779 | A | 8/1998 | Stewart | |
| 5,941,540 | A | 8/1999 | O'Haire | |
| 6,135,837 | A | 10/2000 | Giles | |
| 6,544,089 | B2 | 4/2003 | Zapatero Denegri | |
| 6,702,634 | B2 | 3/2004 | Jung | |
| 7,029,351 | B1 | 4/2006 | Reid et al. | |
| 7,083,173 | B2 | 8/2006 | Lehr et al. | |
| 7,144,285 | B1 | 12/2006 | Hendricks | |
| 7,438,618 | B1 | 10/2008 | Lam | |
| 7,648,449 | B1 * | 1/2010 | Detert | 482/111 |

(Continued)

*Primary Examiner* — S. Joseph Morano
*Assistant Examiner* — Andrew Polay

(57) ABSTRACT

The present invention features a body board system for giving a user a greater sense of maneuverability and control when using the body board. The system features a generally planar body board having a channel located in a body board top surface. The system features a first pivoting base located in a channel first end and a second pivoting base located in a channel second end. A handle assembly is pivotally located on the top surface and features a handle with a handle first end pivotally located on the first pivoting base and a handle second end pivotally located on the second pivoting base. For a first position, the handle is adapted to be pivoted from the channel and raised to an angle for use by a user and for a second position the handle is adapted to be pivoted into the channel.

7 Claims, 7 Drawing Sheets

(56) References Cited

U.S. PATENT DOCUMENTS

2002/0166493 A1* 11/2002 Sorensen ..... 114/343
2004/0161986 A1 8/2004 Scozzari
2004/0173649 A1 9/2004 Luedtke
2006/0148344 A1 7/2006 Erb, Jr. et al.
2008/0194161 A1 8/2008 Lin

* cited by examiner

BODY BOARD SYSTEM

CROSS REFERENCE

This application claims priority to U.S. Patent Application No. 61/595,199 filed Feb. 6, 2012, the specification(s) of which is/are incorporated herein in their entirety by reference.

FIELD OF THE INVENTION

The present invention relates to an apparatus for a user to employ for water surface sports.

BACKGROUND OF THE INVENTION

Body boarding is a water surface sport in which a user rides a body board on a wave as it carries the user towards a shore. A typical body board consists of a short, generally flat, rectangular piece of hydrodynamic foam, sometimes containing one or more short graphite rods within the core for support. Body boarders typically wear swim fins for additional propulsion and control while riding a wave. Three basic forms of riding a body board include prone (on the stomach), drop-knee, and stand-up. The present invention features a body board system for giving a user a greater sense of maneuverability and control.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a body board system for giving a user a greater sense of maneuverability and control. In some embodiments, the system comprises a generally planar body board. In some embodiments, a channel is located in a body board top surface. In some embodiments, the system comprises a first pivoting base located in a channel first end and a second pivoting base located in a channel second end. In some embodiments, the system comprises a handle assembly pivotally located on the body board top surface. In some embodiments, the handle comprises a handle first end pivotally located on the first pivoting base and a handle second end pivotally located on the second pivoting base. In some embodiments, for a first position, the handle is adapted to be pivoted from the channel and raised to an angle for use by a user. In some embodiments, for a second position, the handle is adapted to be pivoted into the channel.

DESCRIPTION OF PREFERRED EMBODIMENTS

Figure 1:
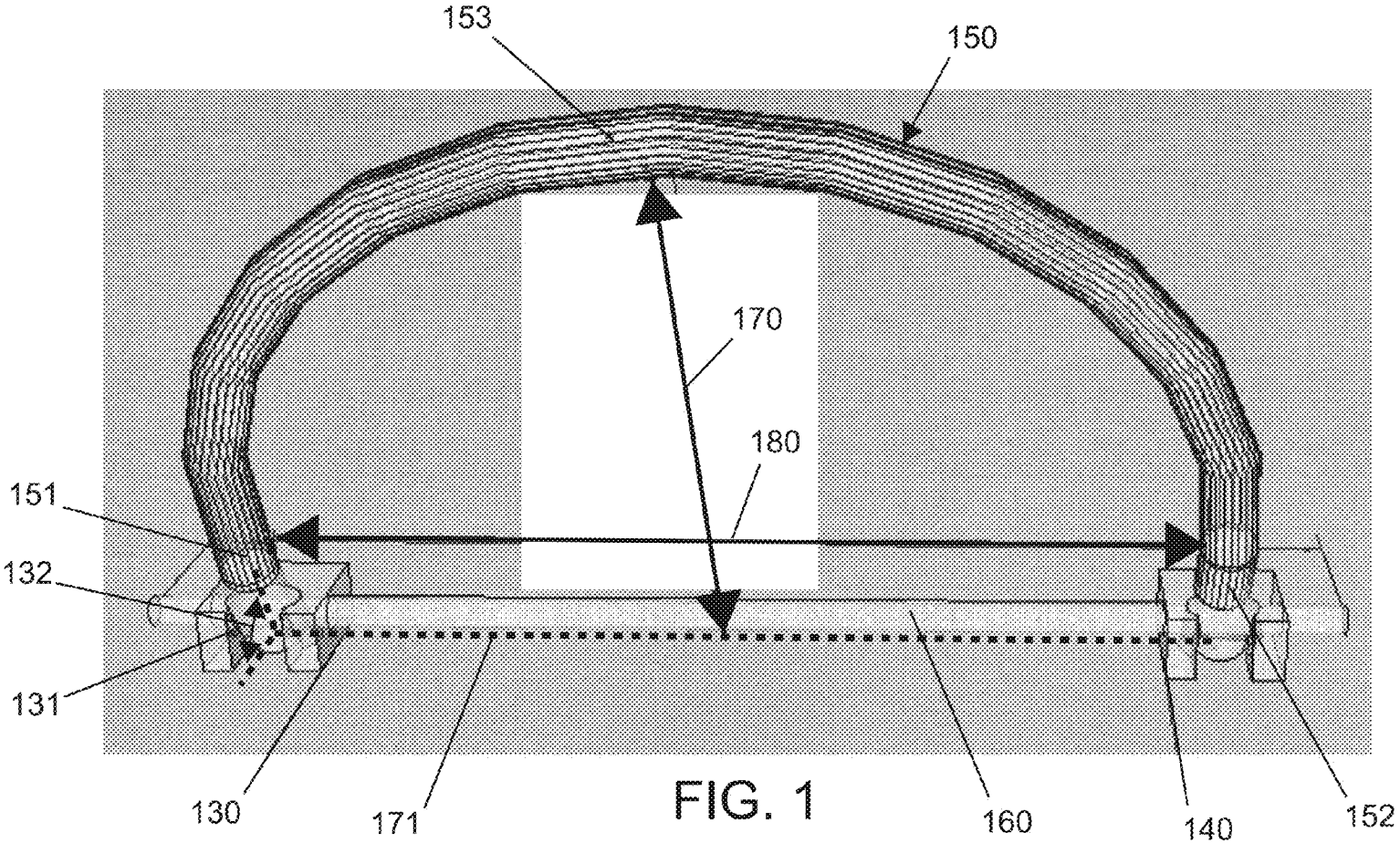
FIG. 1 shows a perspective view of the handle of the present invention.
Figure 2:
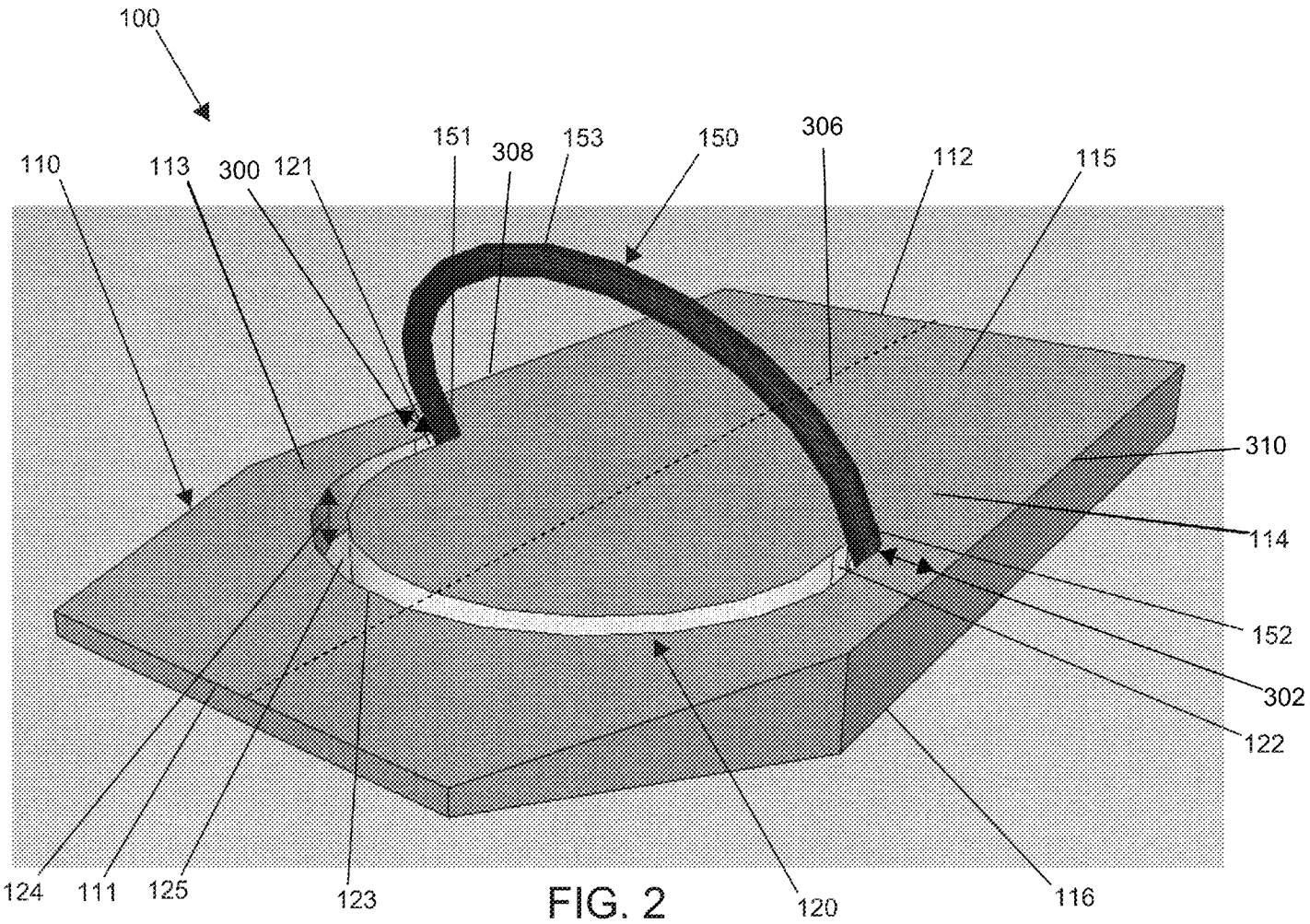
FIG. 2 shows a perspective view of the present invention.
Figure 3:
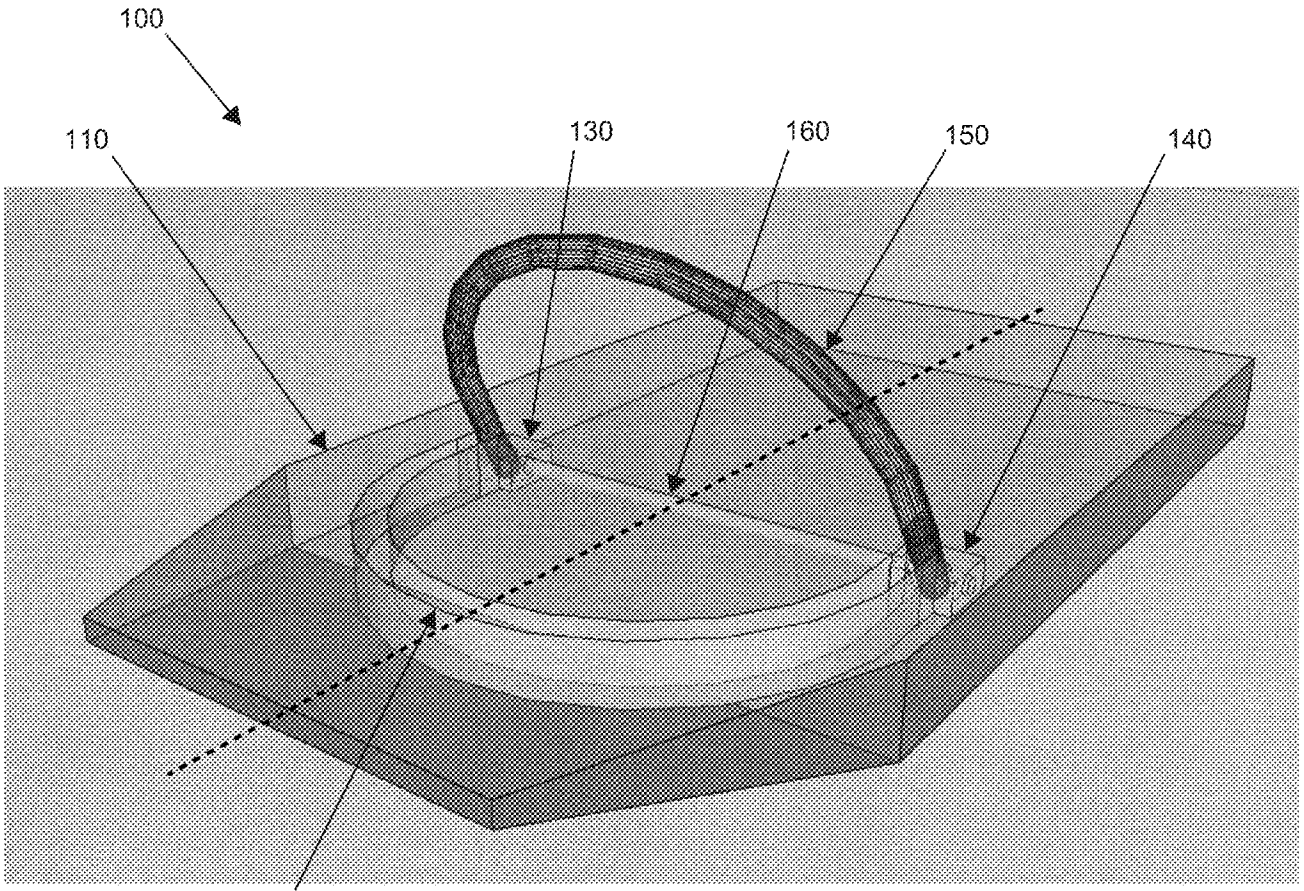
FIG. 3 shows a perspective view of the present invention.
Figure 4:
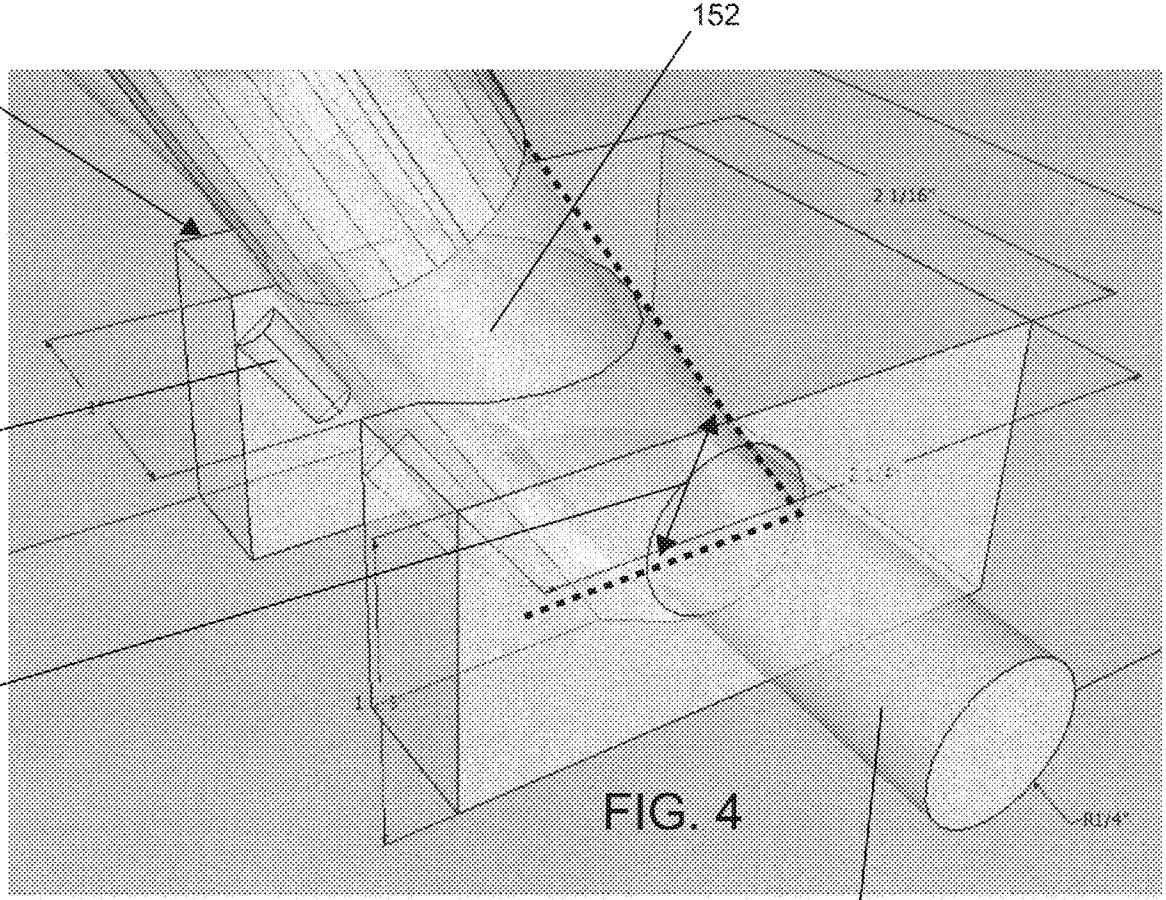
FIG. 4 shows a perspective view of the second pivoting base of the present invention.
Figure 5:
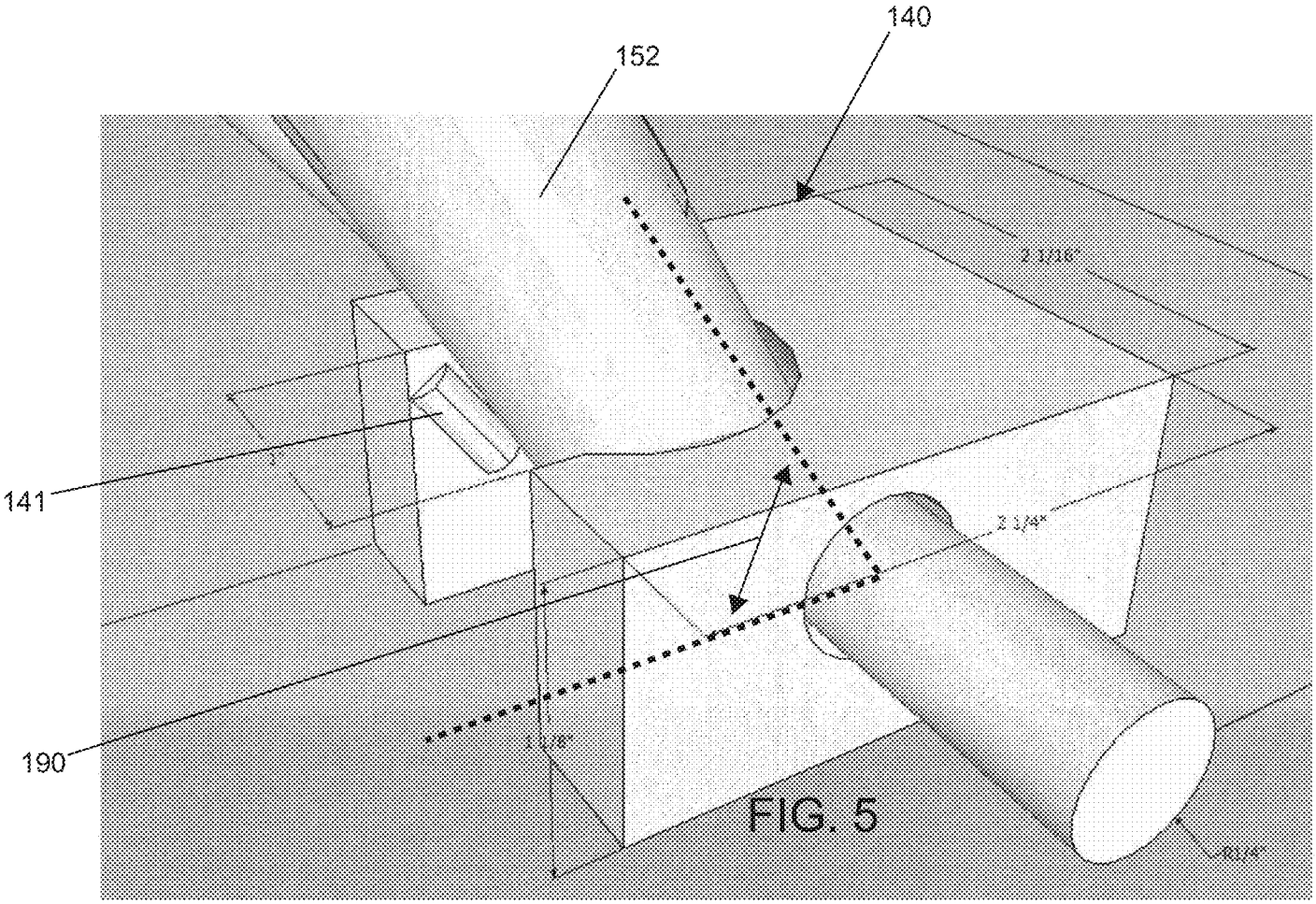
FIG. 5 shows a perspective view of the second pivoting base of the present invention.
Figure 6:
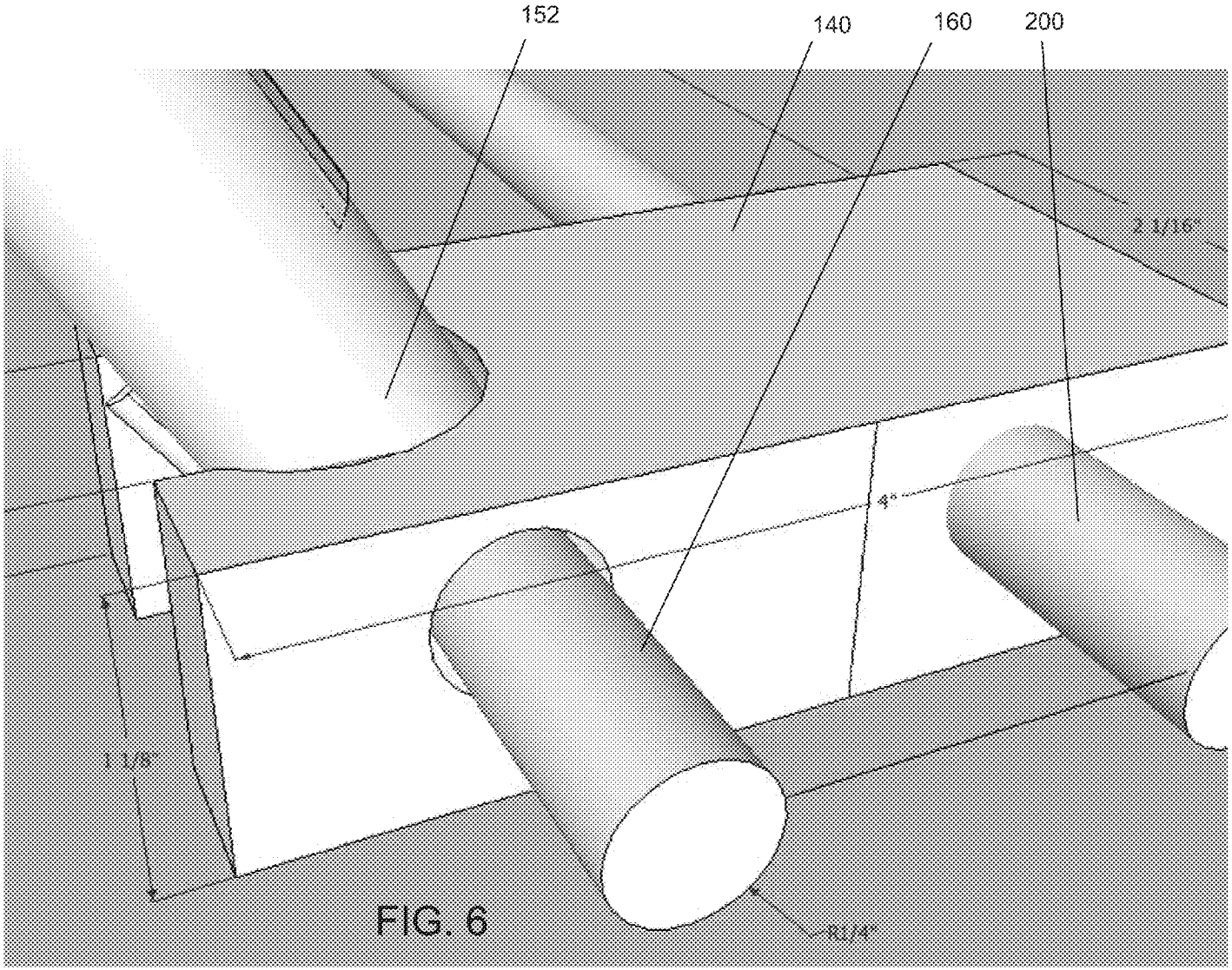
FIG. 6 shows a perspective view of an alternate embodiment of the second pivoting base of the present invention.
Figure 7:
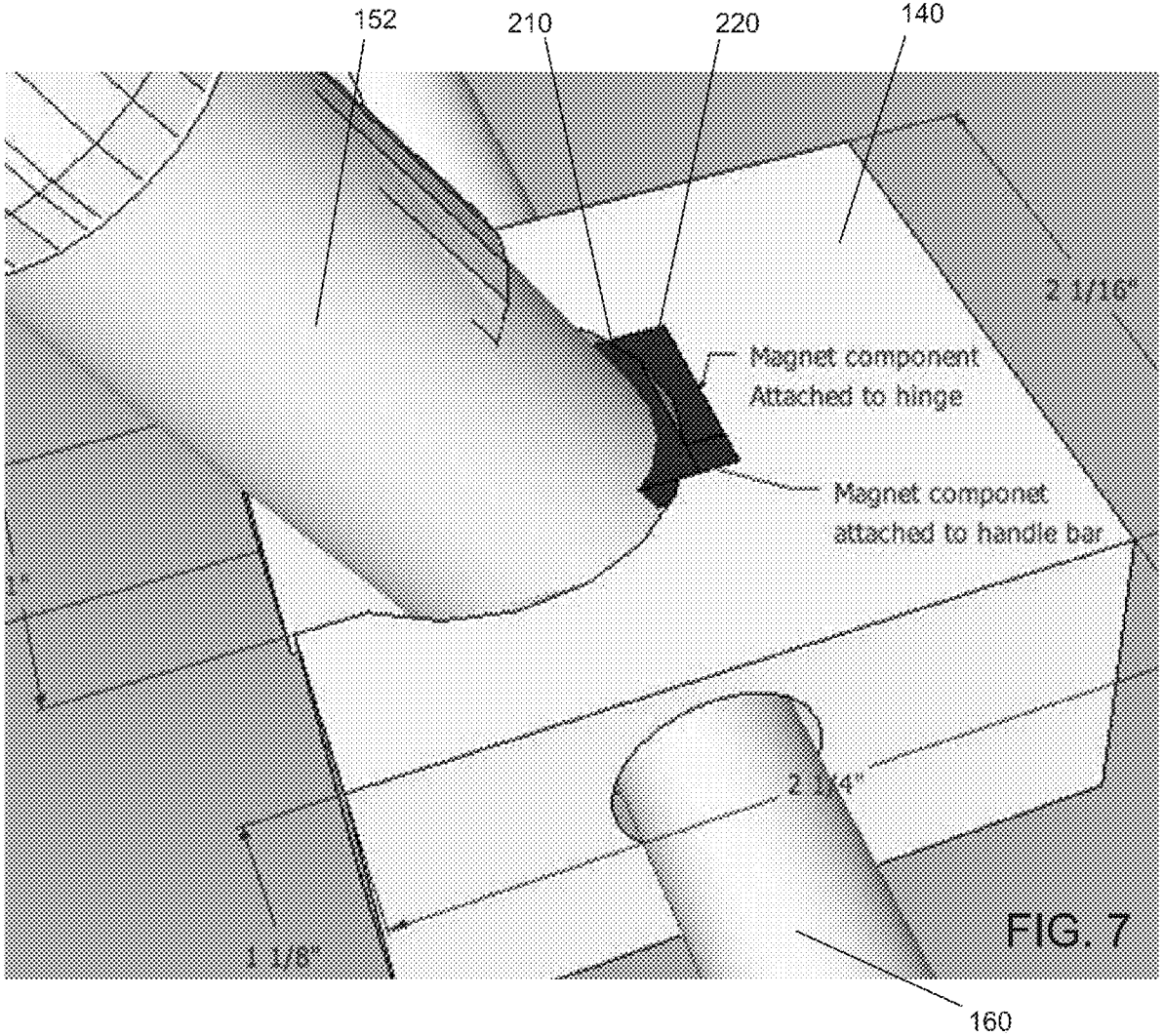
FIG. 7 shows a perspective view of an alternate embodiment of the second pivoting base of the present invention.

Following is a list of elements corresponding to a particular element referred to herein:

100 Body board system
110 Body board
111 Body board anterior edge
112 Body board posterior edge
113 Body board first side
114 Body board second side
115 Body board top surface
116 Body board bottom surface
120 Channel
121 Channel first end
122 Channel second end
123 Channel top
124 Channel depth
125 Channel floor
130 First pivoting base
131 First hemi cylindrical nub
132 First back wall angle
140 Second pivoting base
141 Second hemi cylindrical nub
142 Second back wall angle
150 Handle
151 Handle first end
152 Handle second end
153 Handle top
160 Axle rod
170 Handle height
171 Axis
180 Handle width
190 Angle
200 Stabilizing rod
210 First magnetic component
220 Second magnetic component;
300 First distance;
302 Second distance;
306 Midline;
308 Body board first side edge;
310 Body board second side edge Referring now to FIG. 1-7, the present invention features a body board system (100) for giving a user a greater sense of maneuverability and control. In some embodiments, the system (100) comprises a generally planar body board (110) having a body board anterior edge (111), an opposing body board posterior edge (112), a body board first side (113), an opposing body board second side (114), a body board top surface (115), and an opposing body board bottom surface (116). In some embodiments, the corners are rounded.

In some embodiments, a channel (120) is located in the body board top surface (115) having a channel first end (121), a channel second end (122), a channel top (123), a channel floor (125), and a channel depth (124). In some embodiments, the channel first end (121) is located close to the body board first side (113) and the channel second end (122) is located close to the body board second side (114). In some embodiments, the channel top (123) is located close to the body board anterior edge (111). In some embodiments, the channel depth (124) is measured between a body board top surface (115) and the channel floor (125). In some embodiments, the channel depth (124) is less than half of the body board thickness (the distance between the body board top surface (115) and the body board bottom surface (116)). In some embodiments, the channel depth (124) is less than ¾ of the body board thickness (the distance between the body board top surface (115) and the body board bottom surface (116)). In some embodiments, the channel depth (124) is less than the body board thickness (the distance between the body board top surface (115) and the body board bottom surface (116)).

In some embodiments, the system (100) comprises a first pivoting base (130) located in the channel first end (121) and a second pivoting base (140) located in the channel second end (122). In some embodiments, the first pivoting base (130) comprises a first hemi cylindrical nub (131) located thereon. In some embodiments, the second pivoting base (140) comprises a second hemi cylindrical nub (141) located thereon.

In some embodiments, the system (100) comprises a handle (150) pivotally located on the body board top surface (115). In some embodiments, the handle (150) comprises a handle first end (151), a handle second end (152), and a handle top (153). In some embodiments, the handle first end (151) is pivotally located on the first pivoting base (130) and the handle second end (152) is pivotally located on the second pivoting base (140) via a single axle rod (160). In some embodiments, the single axle rod (160) is located through a cross-section of the first pivoting base (130) and the handle first end (151), and the second pivoting base (140) and the handle second end (152). In some embodiments, one axle rod (160) is used for the handle first end (151) and the first pivoting base (130) and another, second axle rod (160) is used for the handle second end (152) and the second pivoting base (140). In some embodiments, the first pivoting base (130) and the second pivoting base (140) each comprise a first component having a recess disposed therein. In some embodiments, a second component is movably disposed in the recess of the first component. In some embodiments, the second component is a rotating rod that traverses the first component via a channel disposed through the first component.

In some embodiments, a handle height (170) measured between a center of an axis (171) having a beginning at the handle first end (151) and an ending at the handle second end (152) and the handle top (153) is at least one half a handle width (180) measured between the handle first end (151) and the handle second end (152). In some embodiments, the handle height (170) is at least ¾ a handle width (180). In some embodiments, the handle height (170) is at least a handle width (180).

In some embodiments, for a first position, the handle (150) is adapted to be pivoted from the channel (120) and raised to an angle (190) for use by a user. In some embodiments, the angle (190) is set via the handle interfacing against a first back wall angle (132) located in the first pivoting base (130) and a second back wall angle (142) located in the second pivoting base (140). In some embodiments, the angle (190) is 15 degrees. In some embodiments, the angle (190) is 30 degrees. In some embodiments, the angle (190) is 45 degrees. In some embodiments, the angle (190) is 60 degrees. In some embodiments, the angle (190) is 75 degrees. In some embodiments, the angle (190) is 90 degrees. In some embodiments, the angle (190) is 105 degrees. In some embodiments, the angle (190) is 120 degrees. In some embodiments, the angle (190) is 135 degrees. In some embodiments, the angle (190) is 150 degrees. In some embodiments, the angle (190) is 165 degrees. In some embodiments, the angle (190) is 180 degrees.

In some embodiments, the handle (150) is held into place via the first hemi cylindrical nub (131) located on the first pivoting base (130) and the second hemi cylindrical nub (141) located on the second pivoting base (140).

In some embodiments, the handle (150) is held the first pivoting base (130) via a first magnetic component (210) disposed on the handle (150) proximal to the handle first end (151) and a second magnetic component (220) disposed on the first pivoting base (130). In some embodiments, the first magnetic component (210) is magnetically attracted to the second magnetic component (220). In some embodiments, the handle (150) is held the second pivoting base (140) via a first magnetic component (210) disposed on the handle (150) proximal to the handle second end (152) and a second magnetic component (220) disposed on the second pivoting base (140). In some embodiments, the first magnetic component (210) is magnetically attracted to the second magnetic component (220).

In some embodiments, for a second position, the handle (150) is adapted to be pivoted into the channel (120) against the channel floor (125). In some embodiments, the handle (150) snaps into place in the channel (120).

In some embodiments, the handle (150) is arc-shaped and comprises 180 degrees. In some embodiments, the channel (120) is arc-shaped and comprises 180 degrees.

In some embodiments, the handle (150) comprises a shape of one-half of a polygon. In some embodiments, the channel (120) comprises a shape of one-half of a polygon. For example, one-half of a hexagon.

In some embodiments, the handle (150) is foam covered. In some embodiments, the handle (150) is covered in spongy foam. In some embodiments, the handle (150) is rubber or silicone rubber covered. In some embodiments, the handle (150) is covered in spongy rubber or silicone rubber.

In some embodiments, the handle (150) is rigid. In some embodiments, the handle (150) is constructed from plastic tubing. In some embodiments, the handle (150) is constructed from plastic pipe. In some embodiments, the handle (150) is constructed from metal (e.g., aluminum) tubing. In some embodiments, the handle (150) is constructed from metal (e.g., aluminum) pipe.

In some embodiments, the handle (150) is located flush within the channel (120). In some embodiments, the handle (150) is located flush with the body board top surface (115) within the channel (120).

In some embodiments, the body board (110) is 38 to 43 inches in length from the body board anterior edge (111) to the body board posterior edge (112).

In some embodiments, the body board (110) is constructed from a foam 'core' made of polyethylene, Arcel® by Arco Chemical, or polypropylene. In some embodiments, the core is encapsulated by a body board bottom surface (116) made of DuPont™ Surlyn® or HDPE (High Density Polyethylene).

In some embodiments, the body board top surface (115) (deck) and sides (rails) are constructed from a soft foam known by the term CrossLink foam.

In some embodiments, the body board (110) contains one, two, or three stabilizing rods (200) traversing longitudinally inside the core. In some embodiments, the stabilizing rods (200) are constructed from carbon or graphite. In some embodiments, the stabilizing rods (200) are constructed from plastic, wood, fiberglass or another composite, or foam. In some embodiments, the stabilizing rods (200) are referred to as stringers. In some embodiments, the stabilizing rod (200) is attached to the first pivoting base (130) and the second pivoting base (140). In some embodiments, stringers are attached to the first pivoting base (130) and the second pivoting base (140). In some embodiments, the stabilizing rod (200) or stringer is not attached to the first pivoting base (130) and the second pivoting base (140).

In some embodiments, a mesh layer may be used as a strengthening alternative to stringers or stabilizing rods (200). In some embodiments, mesh is attached to the first pivoting base (130) and the second pivoting base (140).

In some embodiments, the body board (110) contains a stabilizing rod (200) traversing perpendicular to the axle rod (160). In some embodiments, the body board (110) contains a plurality of stabilizing rods (200) traversing perpendicular to the axle rod (160). In some embodiments, the stabilizing rod (200) is a stringer.

In some embodiments, the body board (110) contains a stabilizing rod (200) traversing parallel to the axle rod (160). In some embodiments, the body board (110) contains a plurality of stabilizing rods (200) traversing parallel to the axle rod (160). In some embodiments, the stabilizing rod (200) is attached to the first pivoting base (130) and the second pivoting base (140). In some embodiments, the stabilizing rod (200) is attached to an extended length first pivoting base (130) and an extended length second pivoting base (140). In some embodiments, stabilizing rod (200) is located through a cross-section of the first pivoting base (130) and the second pivoting base (140).

In some embodiments the first pivoting base (130) and the second pivoting base (140) are each about 2 inches in length. In some embodiments the first pivoting base (130) and the second pivoting base (140) are each about 2.5 inches in length. In some embodiments the first pivoting base (130) and the second pivoting base (140) are each about 3 inches in length. In some embodiments the first pivoting base (130) and the second pivoting base (140) are each about 3.5 inches in length. In some embodiments the first pivoting base (130) and the second pivoting base (140) are each about 4 inches in length. In some embodiments the first pivoting base (130) and the second pivoting base (140) are each about 4.5 inches in length. In some embodiments the first pivoting base (130) and the second pivoting base (140) are each about 5 inches or more in length.

In some embodiments the first pivoting base (130) and the second pivoting base (140) are each about 2 inches in width. In some embodiments the first pivoting base (130) and the second pivoting base (140) are each about 2.5 inches in width. In some embodiments the first pivoting base (130) and the second pivoting base (140) are each about 3 inches in width.

In some embodiments, channels are located on the body board (110) to increase surface area in the critical parts of the body board (110).

In some embodiments, the body board (110) comprises a crescent tail to provide the greatest amount of hold in steep waves. In some embodiments, the body board (110) comprises a bat tail to provide looseness for rail to rail transitions.

In some embodiments, the first pivoting base (130) and the second pivoting base (140) each comprise a socket located therein. In some embodiments, the handle first end (151) and the handle second end (152) each comprise a ball located thereon. In some embodiments, the ball of the handle first end (151) is located in the socket of the first pivoting base (130). In some embodiments, the ball of the handle second end (152) is located in the socket of the second pivoting base (140).

As used herein, the term "about" refers to plus or minus 10% of the referenced number.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A body board system (100) for giving a user a greater sense of maneuverability and control, the system (100) comprising:

(a) a generally planar body board (110) having a body board anterior edge (111), an opposing body board posterior edge (112), a body board first side (113), an opposing body board second side (114), a body board top surface (115), and an opposing body board bottom surface (116), wherein a channel (120) is disposed in the body board top surface (115) having a channel first end (121), a channel second end (122), a channel top (123), a channel floor (125), and a channel depth (124), wherein the channel first end (121) is disposed adjacent to the body board first side (113) and the channel second end (122) is disposed adjacent to the body board second side (114), wherein the channel top (123) is disposed adjacent to the body board anterior edge (111), wherein the channel depth (124) is measured between a body board top surface (115) and the channel floor (125);

(b) a first pivoting base (130) disposed in the channel first end (121) and a second pivoting base (140) disposed in the channel second end (122), wherein the first pivoting base (130) comprises a first nub (131) disposed thereon, wherein the second pivoting base (140) comprises a second nub (141) disposed thereon;

wherein a first distance (300) from the first pivoting base to the body board first side edge (308) is the same as a second distance (302) from the second pivoting base to the body board second side edge (310); and (c) a handle (150) pivotally disposed on the body board top surface (115), wherein the handle (150) comprises a handle first end (151), a handle second end (152), and a handle top (153), wherein the handle first end (151) is pivotally disposed on the first pivoting base (130) and the handle second end (152) is pivotally disposed on the second pivoting base (140) via a single axle rod (160) disposed through a cross-section of the first pivoting base (130) and the handle first end (151), and the second pivoting base (140) and the handle second end (152);

wherein the handle (150) arches over a midline (306) that symmetrically divides the body board (110) into the body board first side (113) and the body board second side (114);

wherein BOTH sides of the channel (120) conform and trace to the shape of the handle (150);

wherein a handle height (170) measured between a center of an axis (171) having a beginning at the handle first end (151) and an ending at the handle second end (152) and the handle top (153) is at least one half a handle width (180) measured between the handle first end (151) and the handle second end (152);

wherein for a first position, the handle (150) is adapted to be pivoted from the channel (120) and raised to an angle (190) for use by a user, wherein the angle (190) is set via the handle interfacing against a first back wall angle (132) disposed in the first pivoting base (130) and a second back wall angle (142) disposed in the second pivoting base (140);

wherein the handle (150) is held into place via the first hemi cylindrical nub (131) disposed on the first pivoting base (130) and the second hemi cylindrical nub (141) disposed on the second pivoting base (140);

wherein for a second position, the handle (150) is adapted to be pivoted into the channel (120) against the channel floor (125), wherein the handle (150) is disposed flush with the body board top surface (115) within the channel (120).

2. The system (100) of claim 1, wherein the handle (150) is arc-shaped and consists of 180 degrees.

3. The system (100) of claim 1, wherein the channel (120) is arc-shaped and consists of 180 degrees.

4. The system (100) of claim 1, wherein the handle (150) consists of a shape of one-half of a polygon.

5. The system (100) of claim 1, wherein the channel (120) consists of a shape of one-half of a polygon.

6. The system (100) of claim 1, wherein the handle (150) is foam covered.

7. The body board system of claim 1 wherein the first nub (131) and second nub (141) are hemi cylindrical in shape.

* * * * *